United States Patent [19]

Hook, Jr. et al.

[11] Patent Number: 4,666,368

[45] Date of Patent: May 19, 1987

[54] SWIRL NOZZLE FOR A COOLING SYSTEM IN GAS TURBINE ENGINES

[75] Inventors: Richard B. Hook, Jr., Burnt Hills; Richard D. Montanye, Scotia, both of N.Y.

[73] Assignee: General Electric Company, Schenectady, N.Y.

[21] Appl. No.: 857,869

[22] Filed: May 1, 1986

[51] Int. Cl.[4] ..... F01D 5/18

[52] U.S. Cl. ..... 415/115; 416/95; 416/96 A

[58] Field of Search ..... 416/95, 92, 96 A; 415/115

[56] References Cited

U.S. PATENT DOCUMENTS

| | | | |
|---|---|---|---|
| 2,988,325 | 6/1961 | Dawson | 415/115 X |
| 3,619,076 | 11/1971 | Kydd | 416/95 X |
| 3,791,758 | 2/1974 | Jenkinson | 416/95 X |
| 3,972,181 | 8/1976 | Swayne | 415/115 |
| 4,113,406 | 9/1978 | Lee et al. | 416/95 X |
| 4,117,669 | 10/1978 | Heller | 416/95 X |
| 4,178,129 | 12/1979 | Jenkinson | 416/95 |
| 4,214,852 | 7/1980 | Tuley et al. | 415/115 |
| 4,314,791 | 2/1982 | Weiler | 415/115 |
| 4,375,891 | 3/1983 | Pask | 415/115 X |
| 4,435,123 | 3/1984 | Levine | 416/95 |
| 4,456,427 | 6/1984 | Evans et al. | 416/95 |

FOREIGN PATENT DOCUMENTS

| | | | |
|---|---|---|---|
| 215390 | 6/1956 | Australia | 416/95 |
| 471074 | 1/1951 | Canada | 416/191 |
| 165802 | 9/1984 | Japan | 416/191 |

*Primary Examiner*—Everette A. Powell, Jr.
*Attorney, Agent, or Firm*—Jerome C. Squillaro

[57] ABSTRACT

Cooling air from turbine nozzle vanes of a hot gas turbine engine is collected from the vanes by an air connector. A conduit connects to the connector and terminates adjacent a turbine wheel so that air flows through the vanes and through the conduit to be emitted from the end thereof in a jet stream directed against the turbine wheel. A vaned swirl nozzle is inserted in the conduit and adjacent a turbine wheel to impart a turning impetus to the air flow stream being emitted from the nipple. The emitted air stream is then directed tangentially against or adjacent the turbine wheel in the direction of rotation thereof.

6 Claims, 3 Drawing Figures

SWIRL NOZZLE FOR A COOLING SYSTEM IN GAS TURBINE ENGINES

FIELD OF THE INVENTION

This invention relates to an air cooling system in gas turbine engines and more particularly to a swirl nozzle means in the air cooling system to direct cooling air from a turbine nozzle vane tangentially against a turbine wheel.

BACKGROUND OF THE INVENTION

Hot gas turbine engines employ one or more combustion chambers in which the combustion of a fuel air mixture generates a supply of hot gas. The hot gas is directed from the combustion chamber to one or more turbine wheels where the hot gas is caused to flow between turbine buckets or blades which are mounted in a peripheral row on each turbine wheel. These buckets or blades react to the impinging hot gas to convert energy in the gas to rotational movement of the turbine wheels. In some cases, the turbine wheels are mounted on a common shaft with an air compressor and the rotating turbine wheels then also drive the compressor which supplies air for fuel combustion in the engines. Because the engine utilizes a large supply of very hot gases flowing therethrough, a number of components and engine structures which are exposed to the hot gas are caused to reach very high temperatures. In some cases, the temperatures of these parts and components reach a level where they are potentially structurally detrimental. In such cases, cooling air may be taken from the compressor and utilized to cool the noted components and structures. Such cooling air may have a substantial velocity component so that due care must be exercised with regard to the direction of the cooling air in impinging on parts of the engine which may be moving or rotating at very high RPM. Further, a significant volume of coolant air is utilized, and its ultimate disposal within the engine in an advantageous manner is desirable.

OBJECTS OF THE INVENTION

It is an object of this invention to conduct a supply of coolant air, flowing through the nozzle guide vanes of a hot gas turbine engine, along an appropriate flow path, to be discharged as a jet air stream tangentially adjacent a preceding one of a pair of turbine wheels in the direction of rotation of the preceding wheel.

It is another object of this invention to provide an improved swirl nozzle in the jet air stream to impose a turning effect on the jet air stream and cause it to be directed in a tangential direction adjacent a turbine wheel in the direction of rotation thereof.

It is another object of this invention to provide for ultimate disposal of the described jet air stream into the mass flow of air through the engine.

SUMMARY OF THE INVENTION

The coolant air flowing through the nozzle vanes between a pair of turbine wheels in a hot gas turbine engine is directed through appropriate conduits to an aperture in a wall facing a turbine wheel. A jet of air issues from the aperture in the direction of the turbine wheel. A specially adapted swirl nozzle is positioned in the aperture. Coolant air passes into the aperture and through the swirl nozzle. Air control vanes in a rectangular section of an air passage through the nozzle impose a turning effort on the passing air stream so that it issues from the nozzle as a jet of air directed tangentially adjacent a preceding turbine wheel in the direction of rotation thereof. The jet of cooling air which issues from the nozzle is directed adjacent a preceding turbine wheel in the general area where the turbine wheel buckets or blades are affixed to the wheel disc. After the supply of air is utilized for coolant purposes, it is caused to flow along predetermined paths in the engine to be mixed with the mass flow of air through the engine for an increase in the efficiency thereof.

This invention will be better understood when taken in connection with the following description and drawings.

DESCRIPTION OF A PREFERRED EMBODIMENT OF THE INVENTION

Figure 1:
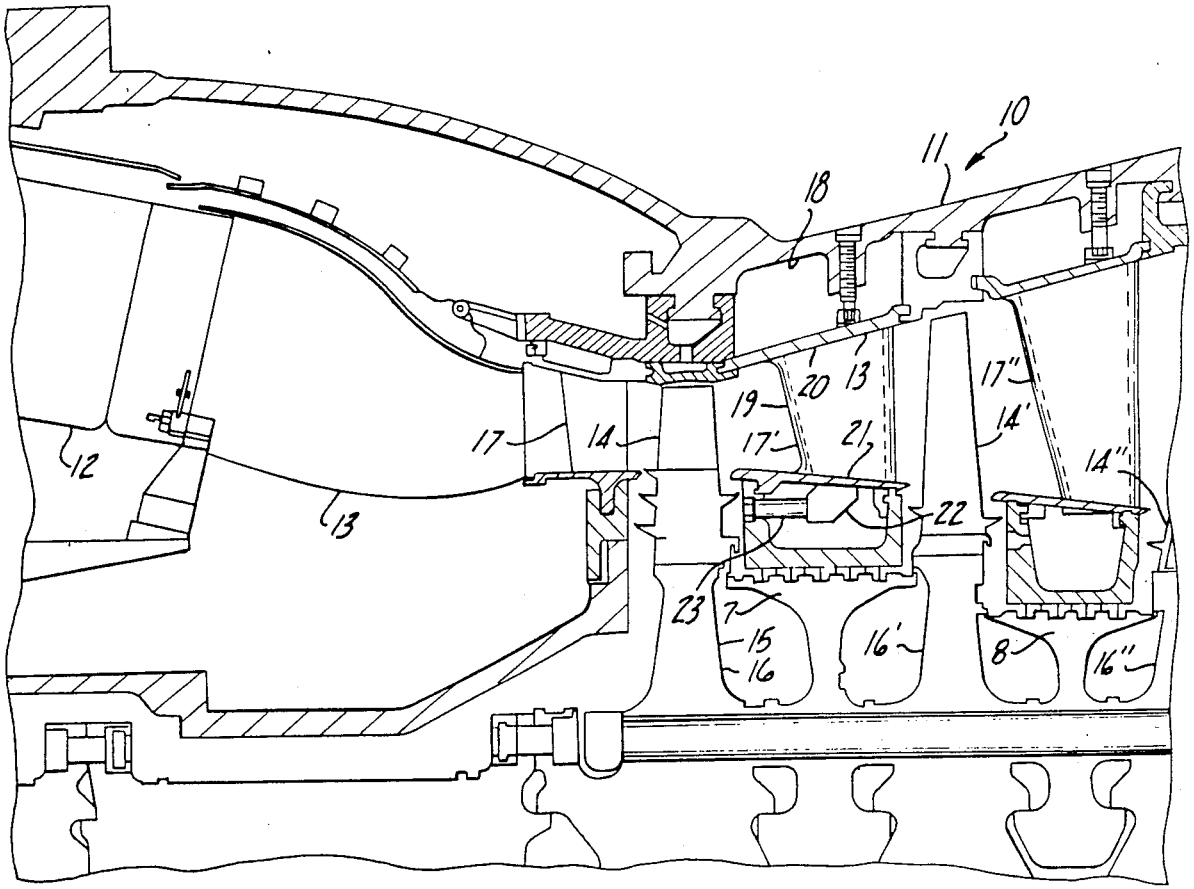
FIG. 1 is a partial sectional and elevational view of a hot gas turbine engine.

In FIG. 1, for the purpose of a description of this invention, only the relevant details of a gas turbine engine have been illustrated. In FIG. 1, a hot gas turbine engine 10 includes a rigid casing 11 which also serves as the frame of the engine. Engine 10 includes an air compressor (not shown) which supplies air to a combustion chamber 12. A suitable fuel is introduced into combustion chamber 12 where it is mixed with air from the compressor, ignited, and burned. In a typical hot gas turbine engine, a plurality of combustion chambers such as combustion chamber 12 are mounted in a circumferential row about the centerline of the engine 10. The hot combustion gas from the combustion chamber 12 enters an annular passage or chamber 13 which directs the hot gas between turbine wheel buckets or blades 14 which are mounted in a peripheral row on a turbine disc 15. The combination of turbine buckets and blades together with a turbine disc or rotor is referred to as a turbine wheel. One or more turbine wheels may be employed in a hot gas turbine engine.

As illustrated in FIG. 1, three axially spaced turbine wheels 16, 16' and 16'' are employed and the buckets and blades 14, 14' and 14'' of each wheel extend into the annular passage 13 so that the hot gas flowing therein from the combustion chamber 12 impinges on the blades 14, 14' and 14'' of each turbine wheel in succession to impart rotational energy to the wheels. The reaction of the blades 14 to the hot gas flow imparts some change in direction and some rotational velocity component to the hot gas flow just after passing between blades 14. Energy exchange from the hot gas flow to the blades 14 is greatest, however, when the hot gas flows a substantially axial flow pattern between the turbine wheels and is directed to impinge blades 14 in an optimum manner and direction.

Therefore, in order to direct the hot gas flow into the blades 14 in an optimum manner and direction, an annular row of nozzle or guide vanes 17 are installed in the hot gas flow in passage 13. As illustrated, three rows of nozzle guide vanes 17, 17' and 17'' are employed, one row next adjacent each of the three turbine wheels 16, 16' and 16'', so that there is one turbine wheel, for example wheel 16, which is a preceding turbine wheel between the combustion chamber 12 and a row of vanes 17' or, wheel 16 is a preceding turbine wheel to the row of vanes 17'. Nozzle vanes 17 are positioned directly in the hot gas flow in passage 13, and are subjected to extremely high temperatures which could cause warping or other structural deformation or damage. As a consequence, some means of cooling vanes 17 is desirable. In FIG. 1, a supply of air is taken from the compressor prior to its introduction into combustion chamber 12 and introduced into an annular chamber or plenum 18 which concentrically surrounds a row of vanes 17' next adjacent second stage turbine wheel 16'. Vanes 17 may be hollow (as indicated by the dashed lines) or provided with vertical air passages therethrough which are connected in air flow relationship to plenum 18. Coolant air from plenum 18 is caused to flow radially inwardly through vanes 17' for cooling thereof. One important factor associated with such a cooling arrangement is the need for some means to effectively utilize the maximum cooling capacity of the available coolant air, as well as some means to ultimately dispose of this coolant air in the engine, preferably in an advantageous or beneficial manner. FIG. 1 illustrates certain engine structure adapted for these purposes.

In FIG. 1, there is shown first and second stage turbine wheels 16 and 16'. Interposed between each pair of turbine wheels are spacer wheels 7, 8 and 9 (not shown). For example, in FIG. 1, spacer wheel 7 is interposed between adjacent turbine wheels 16 and 16'. Also interposed between successive turbine wheels such as turbine wheels 16 and 16' is a nozzle structure 19. Nozzle structure 19 comprises a series of circumferential segments which, together, comprise a 360° ring structure. Each circumferential segment comprises one or more vanes 17' which are cast integrally with walls 20 and 21 of passage 13. The area or space between turbine wheels is denoted as wheelspace and generally includes the space below wall 21 of the nozzle vane ring structure 19. An air connection 22 depends from the underside of wall 21 and is connected at the outlet end of one or more nozzle structures. Each segment may contain one or more air connectors.

Figure 3:
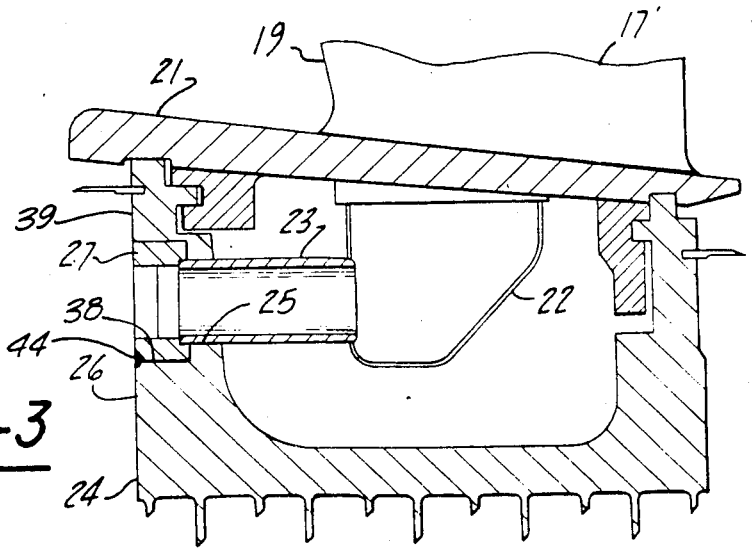
FIG. 3 is an illustration of the swirl nozzle of FIG. 2 in its sub-assembly relationship.

Cooling air from plenum 18 passing through vane 17' enters the connector 22. A rigid open ended conduit or nipple 23 has one end connected in air flow relationship with a connector 22 and the other open end projects axially towards a preceding turbine wheel 16. An air stream emitted from nipple 23 is directed against turbine wheel 16' generally in the region where the blades 14 are affixed to wheel disc 15. There are, therefore, a plurality of separate air connectors, nipples, and diaphragms arranged in a 360° arc in the radially inner space below the assembled wall segments 21. However, in the present engine as illustrated in FIGS. 1 and 3, there is an annular air collector chamber member, referred to as diaphragm 24, which is concentrically positioned below wall 21 of nozzle vane structure 19 and may be a unitary part of nozzle vane structure 19. Each circumferential segment of nozzle vane structure 19 will therefore have its own diaphragm segment. When such a diaphragm 24 is employed, the nipple 23 may have the end which is adjacent turbine wheel 16 terminate in an aperture 25 in upstanding sidewall 26 of chamber 24 as illustrated. Coolant air then passes from vane 17 to connector 22, through nipple 23, and aperture 25 to be directed against turbine wheel 16, generally in the area where the blades 14 are jointed to the wheel disc 15. This is an area here the control of temperature of the turbine wheels becomes extremely important and a cooling arrangement is markedly beneficial.

It has been found that the coolant air jet or stream being emitted from apertures 25 or nipple 23 should be provided with optimal directional characteristics. When the relatively high velocity coolant air jets from apertures 25 are directed perpendicularly against the turbine wheel disc 15, the relative velocity of the coolant air jets relative to the velocity of the wheel 16 is quite large because the wheel direction of rotation and the direction of the air stream from aperture 25 are at right angles to each other, and such an arrangement is not conducive to maximum cooling.

It has been discovered that more effective cooling of wheel disc 15 takes place when the coolant air jets which are emitted from apertures 25 are positively directed tangentially toward the preceding turbine wheel 16 in the direction of rotation thereof. Accordingly, some air flow control means are necessary to provide a positive turning impetus to the coolant air jets from apertures 25. It has been found that a particular vaned nozzle denoted a swirl nozzle may be fitted in aperture 25 and will provide the turning impetus necessary in spite of the very short axial distance available for the turning effort.

Figure 2:
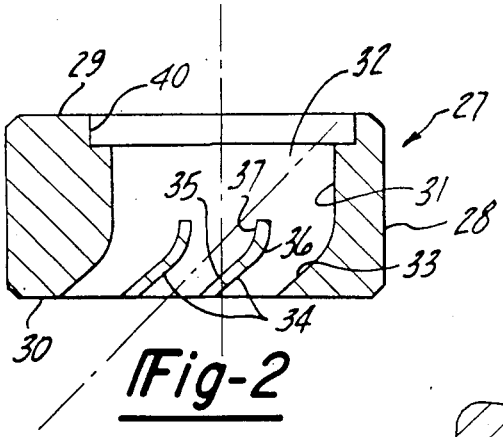
FIG. 2 is a half sectional view of a swirl nozzle of this invention.

A swirl nozzle 27 in accordance with the practice of this invention, is illustrated in FIG. 2. Referring now to FIG. 2, swirl nozzle 27 comprises a short, thick-walled right circular cylinder 28 having a pair of opposite and parallel faces 29 and 30 denoted the entrance and exit faces, respectively. Cylinder 28 also includes a continuous airflow passage 32 therethrough. Passage 32 is generally defined by a pair of successive passages 31 and 33 therein which intersect each other within cylinder 28. The first of these passages, passage 31 is cylindrical in cross section and is referred to as entrance passage 31 whose centerline is perpendicular to face 29 of cylinder 28. The other passage 33 is referred to as the exit passage 33 which is rectangular in cross section, and whose centerline makes an angle of less than about 45 degrees to the plane of face 30 of cylinder 28. Passage 32 is a continuous but angled passage through cylinder 28. The centerlines of each passage 31 and 33 intersect with each other within the cylinder 28 and define the region where the passage 31 changes smoothly from its cylindrical cross section to the rectangular cross section of passage 33.

The defined angled passage 32 alone is insufficient to provide the kind of air turning impetus desired because of the relatively short length of cylinder 28. Ordinarily in order to effectively turn an air stream as described, the turning effort should act on the stream over a significant length of the stream. It was found that the addition of certain turning vanes in the rectangular passage 33 of cylinder 28 provided the desired incremental turning impetus. A plurality of such turning vanes 34 is illustrated in FIG. 2. Vanes 34 are relatively thin, curved, and parallel members which depend and extend from the walls of cylinder 28 which defines passage 32 and particularly from the wall of cylinder 28 which defines rectangular passage 33.

It has been found advantageous to manufacture swirl nozzle 27 by a casting process and accordingly the vanes 34 are cast in place. As illustrated, the vanes 34 extend significantly into the passage 32 and the air stream therein. Most of the vane structure resides in the rectangular part 33 of passage 32. Each vane may be considered as having three sections, a first longitudinal section 35 being parallel to the centerline of passage 33 and extending from face 30 of cylinder 28 to the intersection of passages 31 and 33. At this point there is a curved section 36 making a smooth transition to a very short second longitudinal section 37 which projects into cylindrical passage 31 parallel to the centerline thereof. Vanes 34 provide very effective air flow control means as well as a positive and effective turning effort to turn the air stream flowing through passage 32 so that it exits nozzle 27 in the desired direction.

As can be understood from an examination of FIG. 2, without turning vanes 34, a significant component of a high velocity air stream through passage 32 of cylinder 28 would be emitted in an axial direction since a substantial part of the area of aperture 33 in face 30 is directly opposite aperture 32 in face 29. The curved or angled wall of passage 31 would not alone impart a substantial tangential component to the airstream. Vanes 34, as illustrated, begin to straighten and turn the airflow within cylinder 28 and their curved surfaces provide a measure of flow control for air emitted from rectangular aperture 33 in face 30 of cylinder 28.

By directing cooling air in a tangential manner against a turbine wheel and in the direction of rotation of the turbine wheel, the relative velocity of the air stream with respect to the turbine wheel is reduced and a cooler running turbine wheel results.

FIG. 3 illustrates the assembly of the swirl nozzle 27 of this invention into a hot gas turbine engine. In FIG. 3 a nozzle vane structure 19 contains hollow vanes 17' adapted to pass cooling air from the plenum 18 of FIG. 1 through the vanes 17'. Referring again to FIGS. 1 and 3, from connector 22 the coolant air passes through rigid and fixed nipple 23 and through swirl nozzle 27 of this invention to flow tangentially adjacent rotor disc 15 of the preceding turbine wheel 16. From this point the coolant air escapes radially outwardly along wheel disc 15 and between blades 14 and one end of wall 21 into the hot gases in passage 13 to advantageously become part of the mass flow of air through engine 10.

One method of assembling swirl nozzle 27 into engine 10 is illustrated in FIGS. 2 and 3 and comprises providing a counterbore 38 in and eccentric with aperture 25 in sidewall 26 of diaphragm 24. Nozzle 27 is then pressed into the counterbore 38 until its face 30 is flush with the outer surface 39 of sidewall 26 of diaphragm 24. At this point the end of nipple 23 in aperture 25 will engage counterbore 40 of swirl nozzle 27. Thereafter swirl nozzle 27 may be mechanically retained in counterbore 38 by various means, for example, by staking or peening 44. Some provision must be made in order that, upon successive assembly in engine 10, the swirl nozzle 27 will be correctly aligned and vanes 34 in passage 31 of nozzle 27 will direct an airstream tangentially adjacent turbine wheel disc 15 at the appropriate angle. One means of achieving correct alignment includes boring the counterbore 40 in eccentric relationship with respect to the outside diameter of cylinder 28 or nozzle 27. When nozzle member 27 is inserted in the counterbore 38 of diaphragm 24, the entrance face 29 of nozzle 27 will be adjacent the extended end of nipple 23. Nipple 23 will then protrude into counterbore 38 of diaphragm 24, and, when the eccentricity is correct, counterbore 40 will be engaged with nipple 23 permitting assembly of nozzle 27 into diaphragm 24. When nozzle 27 is inserted in the counterbore 38 of aperture 25, it is rotated therein until the counterbore 40 of passage 32 will align itself correctly to engage the end of nipple 23 and all parts will have the necessary correct alignment.

This invention thus provides a positive tangentially directed coolant airstream for a turbine wheel of a hot gas turbine engine from a nozzle vane cooling system therein.

While a preferred embodiment of this invention has been shown and described, it will be obvious to those skilled in the art that various changes and modifications may be made therein without departing from the scope of the invention as defined by the appended claims.

What is claimed is:

1. An improved gas turbine engine of the type comprising an outer casing, a plurality of axially spaced apart turbine wheels rotatably mounted within the casing and having radially outwardly extending blades mounted thereon; a stationary annular member including air foil vanes positioned between each of the turbine wheels; said bladed turbine wheels and said stationary annular members defining a hot gas path; an annular plenum defined between the hot gas path and an outer wall of the stationary member and a diaphragm depending from an inner wall of the stationary members; air passageways through at least some of the air foil vanes for conducting cooling air from the annular plenum to the diaphragm; and, wherein the improvement comprises:

a plurality of air connectors depending from the inner wall of the annular member each air connector in fluid communication with at least one air foil vane;

at least one aperture formed in the diaphragm facing an upstream preceding turbine wheel;

an enlarged counterbore formed in the diaphragm eccentric to each aperture;

a swirl nozzle inserted into the enlarged counterbore said swirler including an offset swirler counterbore; and, a nipple interconnecting an air connector with a swirler counterbore through an aperture formed in a diaphragm whereby cooling air is delivered from the annular plenum through the air foil vanes into the air connectors through the nipples into the swirler nozzles against an upstream preceding wheel.

2. The improved gas turbine engine recited in claim 1 wherein the swirler nozzle comprises:

a cylindrical block formed with the offset swirler counterbore; an air flow passage through said cylindrical block including an entrance passage concentric with said swirler counterbore and an exit passage continuous with the entrance passage but offset with respect to said entrance passage and swirler counterbore.

3. The improved gas turbine engine recited in claim 2 further comprising swirler nozzle vanes positioned in the exit passage whereby the swirler nozzle is offset with respect to the diaphragm aperture and the exit passage is offset with respect to the swirler nozzle counterbore whereby cooling air is turned through the swirler nozzle and directed in a tangential direction with respect to the preceding turbine wheel.

4. The improvement recited in claim 1 wherein the swirl nozzle insert comprises:

a right circular cylinder having opposite, planar, parallel entrance and exit faces, said entrance face having a cylindrical passage passing therethrough and into said cylinder, said exit face having a passage passing therethrough and into said cylinder to intersect with the said cylinder into said entrance face, the said passage in said exit face having a rectangular cross section, the said entrance face having the swirler counterbore therein in the cylinder passing through said entrance face, said counterbore being eccentric with respect to the outside diameter of said right circular cylinder, said nipple being inserted in said counterbore with the said nozzle member positioned in said aperture.

5. The improvement as recited in claim 4 wherein an aperture in said entrance face is a cylindrical aperture and an aperture in said exit face is a rectangular aperture, the said cylindrical passage passing perpendicularly through said entrance face, the said rectangular passage passing through said exit face at an acute angle with respect to the plane of said exit face and intersecting with said cylindrical passage in said cylinder to provide a continuous and angled passage through said cylinder.

6. A swirl nozzle for a turbine wheel cooling system in a hot gas turbine engine comprising in combination:

(a) a right circular cylinder member having a pair of opposite, parallel planar faces comprising an entrance face and an exit face, (b) said cylinder having an angled air flow passage therethrough from and through the said entrance face and through said cylinder and said exit face, (c) said air flow passage comprising a cylindrical passage projecting axially through said entrance face and into said cylinder, and a rectangular passage projecting angularly through said exit face and into said cylinder to intersect said cylindrical passage and define therewith an angled air flow passage through said cylinder, (d) a plurality of air flow vane members in said rectangular passage to direct the air flow stream passing through said angled air passage and out of said cylinder at its rectangular aperture at an angle of less than about 45 degrees with respect to the plane of said exit face, (e) said cylindrical passage having a counterbore therein adjacent said entrance face.

* * * * *